United States Patent [19]

Wepfer et al.

[11] Patent Number: 4,813,117

[45] Date of Patent: Mar. 21, 1989

[54] METHOD FOR MAKING ANTIVIBRATION BAR

[75] Inventors: Robert M. Wepfer, Murrysville; Hermann O. Lagally, Hempfield Township, Westmoreland County, both of Pa.

[73] Assignee: Westinghouse Electric Corp., Pittsburgh, Pa.

[21] Appl. No.: 143,785

[22] Filed: Jan. 14, 1988

Related U.S. Application Data

[62] Division of Ser. No. 855,277, Apr. 24, 1986, Pat. No. 4,747,373.

[51] Int. Cl.[4] ..... B21D 53/02

[52] U.S. Cl. ..... 29/157.4; 29/157.3 R; 29/557; 122/510; 165/69; 165/162

[58] Field of Search ..... 29/157.4, 157.3 R, 407, 29/557; 376/405; 138/108; 165/162, 69, 178; 122/510

[56] References Cited

U.S. PATENT DOCUMENTS

| | | | |
|---|---|---|---|
| 1,928,009 | 9/1933 | Dornier . | |
| 2,608,388 | 8/1952 | Miller | 122/423 |
| 3,575,236 | 4/1971 | Romanos | 122/510 |
| 3,599,914 | 8/1971 | Stephens . | |
| 3,637,008 | 1/1972 | Michel et al. . | |
| 3,864,811 | 2/1975 | Walker . | |
| 4,120,350 | 10/1978 | Norton | 165/162 |
| 4,208,988 | 6/1980 | Jacobs et al. . | |
| 4,423,703 | 1/1984 | Esselman et al. | 165/162 |
| 4,577,386 | 3/1986 | Faudou et al. . | |
| 4,619,315 | 10/1986 | Waryasz | 165/162 |

FOREIGN PATENT DOCUMENTS

| | | | |
|---|---|---|---|
| 2200462 | 4/1974 | France . | |
| 813152 | 5/1959 | United Kingdom . | |
| 956129 | 4/1964 | United Kingdom . | |
| 1017455 | 1/1966 | United Kingdom . | |
| 1050025 | 12/1966 | United Kingdom . | |
| 1090535 | 11/1967 | United Kingdom . | |
| 1188564 | 4/1970 | United Kingdom . | |
| 1364571 | 8/1974 | United Kingdom . | |
| 1532100 | 11/1978 | United Kingdom | 165/162 |
| 1566633 | 5/1980 | United Kingdom . | |
| 2151766 | 7/1985 | United Kingdom . | |

*Primary Examiner*—P. W. Echols
*Assistant Examiner*—Irene Cuda

[57] ABSTRACT

A method is disclosed for making an apparatus for substantially eliminating flow induced vibrations of the flow tubes of a steam generator in the U-bend region. Antivibration bars are provided between columns of flow tubes in the U-bend region which are contoured on one side to correspond with the exact as-built and as-bent diameter of the tubes as located within the tube bundle. Measurements of the actual flow tube diameters are made and recorded and stored either on tape or in a computer which is then used to control a numerically operated machine which configures or machines cutouts in the antivibration bars to precisely correspond with the respective measured diameters of the flow tubes. Only one side of the antivibration bars need to be machined because of the flexibility of the flow tubes which allow the positioning of the other side of the flow tubes along a flat plane.

8 Claims, 4 Drawing Sheets

METHOD FOR MAKING ANTIVIBRATION BAR

CROSS REFERENCE TO RELATED APPLICATIONS

This is a division of application Ser. No. 855,277, filed Apr. 24, 1986, now U.S. Pat. No. 4,747,373.

This invention is related to U.S. patent applications Ser. No. 745,980, filed June 18, 1985, now U.S. Pat. No. 4,627,959, entitled "Compliant Antivibration Bar for a Steam Generator" by H. O. Lagally, et al; U.S. Ser. No. 729,385, filed May 1, 1985, now U.S. Pat. No. 4,653,576, entitled "Expandable Antivibration Bar for a Steam Generator" by H. O. Lagally; and, U.S. Ser. No. 773,274, filed Sept. 6, 1985, now U.S. Pat. No. 4,718,479 entitled "Antivibration Bar Installation Apparatus" by H. O. Lagally, et al, all of which are assigned to the Westinghouse Electric Corporation.

BACKGROUND OF THE INVENTION

1. Field of the Invention

This invention relates in general to the field of steam generators for commercial nuclear power plants and in particular to apparatus for preventing vibration of the tubes of steam generators and more particularly to apparatus for eliminating clearance space between the tubes of a steam generator and the antivibration bars disposed between the columns of the tubes and thereby eliminating the vibration of said tubes during operation of the steam generator.

2. Description of the Prior Art

Nuclear power plants have been safely producing electricity for many years. The principal of operation of such commercial nuclear power plants is well known. A nuclear core containing fissionable fuel is caused to achieve criticality and thereby produces heat. The heat is removed by a reactor collant, which in the field of pressurized water reactors, comprises water. The water reactor coolant also serves as a nuclear moderator which thermalizes fast neutrons in order to enhance the probability of the neutrons producing additional nuclear fissions and thereby sustaining the nuclear reaction. Since the chain reaction is dependent upon the presence of the nuclear moderator, the absence of the same stops the chain reaction and shuts down the reactor. This is only one of the inherent safety features of a water-cooled nuclear reactor which contributes to the overall high safety factor of such reactors.

The heat produced by the nuclear core is transferred to the reactor coolant as it passes through the nuclear reactor core. The reactor coolant subsequently transfers the heat it has received to another medium, which also comprises water and which is transformed into steam. The steam is then used to generate electricity by conventional steam turbine-electrical generator apparatus.

The reactor coolant transfers its heat to the secondary medium in steam generators specifically designed for the nuclear power field. The design of such nuclear steam generator is well known in the art. In general, the steam generator design comprises a plurality of small diameter tubes which are housed within a pressure-bearing container in such a manner as to allow and promote the transfer of heat to produce steam.

In particular, the design of some nuclear steam generators includes an outer shell comprising an elongated, circular cylinder having rounded ends attached thereto. A large number of U-shaped tubes oriented along the longitudinal axis of the cylinder, are disposed in the lower cylindrically-shaped portion of the steam generator. The lower portion has a lower or bottom end thereof associated with a closure head typically of a hemispherical configuration. The closure head is divided by a partition into a first half typically known as the hot leg, and a second half typically known as the cold leg. The high temperature reactor coolant from the nuclear reactor is input into the steam generator through a primary coolant inlet nozzle into the hot leg. The reactor coolant then flows from the hot leg into the exposed openings of the plurality of U-shaped tubes, through the tubes and then through the cold leg portion of the closure head. Finally, the reactor coolant exits from the steam generator through a primary coolant outlet nozzle.

The portion of the steam generator primarily including the bundle of U-shaped tubes and the closure head is typically referred to as the evaporator section. The steam generator further includes a steam drum section which is located at the upper end of the cylindrical shell of the steam generator. Moisture separators are located within the steam drum section. Feedwater (which comprises recirculating water plus make-up water) enters the steam generator through an inlet nozzle which is disposed in the upper portion of the cylindrical shell. The feedwater is distributed and mixed with water removed by the moisture separation and then flows down an annular channel surrounding the tube bundle. The feedwater then reverses direction and passes up around the outside of the tubes of the tube bundle where it absorbs heat from the reactor coolant flowing with the tubes. The heat absorbed causes the feedwater to boil and produce steam. The steam produced by the boiling water rises into the steam drum section. The moisture separator then removes the water entrained within the steam before it exits from the steam generator through a steam outlet. The steam then flows to the steam turbine which is connected to an electrical generator. Subsequently, the steam from the steam turbine is condensed and re-routed back into the steam generator to continue the flow cycle.

The U-shaped tubes are supported at their open ends by conventional means whereby the ends of the tubes are seal welded to a tube sheet which is disposed transverse to the longitudinal axis of the steam generator. A series of tube supports arranged in spaced relationship to each other are provided along the straight portion of the tubes in order to support such portion of the tubes. An upper tube support assembly is utilized to support the U-shaped portion of the tubes of the tube bundle. The upper assembly comprises a plurality of retainer rings arranged around the outside of the tube bundle in spaced relationship to each other.

The retaining rings, like the tube supports, are arranged substantially transverse to the longitudinal axis of the steam generator. Each retaining ring is generally of an oval shape which coincides with the outer periphery of the tubes bundle at the particular location of the retaining ring. Thus, the size of the oval of the retaining rings decreases with the distance toward the upper end of the tube bundle. The uppermost retaining ring, therefore, is relatively small inasmuch as it is located at the uppermost portion of the tube bundle where the shape of the tube bundle is rapidly converging.

Each of the retaining rings is connected to a plurality of antivibration bars which are typically disposed between each column of the U-shaped portion of the tubes. In some steam generators, the antivibration bars comprise a bar bent into a V-shaped configuration such that two legs are formed with an angle therebetween. The V-shaped bars are inserted between successive columns of the steam generator flow tubes. The V ends of the bars are inserted between the flow tubes; the free ends of the bars are welded to opposite sides of the appropriate retainer ring. In this manner, each of the tubes of the tube bundle is supported along the length of the curved or U-shaped portion at a number of spaced locations by an antivibration bar. This arrangement provides line support and yet allows the feedwater to flow around and between the curved portion of the steam generator tubes. In other words, the antivibration bars provide support and do not substantially interfere with the flow of the feedwater.

The antivibration bars are intended to prevent excessive vibrations of the individual tubes of the entire tube bundle. It is well known that the vibrations in question are caused by flow of the water and steam past the flow tubes. These flow-induced vibrations can potentially damage the flow tubes. It is also well known that the U-shaped portion of the tube bundle is severely affected by the vibrations. And, because of the bent configuration, the most difficult to adequately support in order to eliminate the flow-induced vibrations. Further, it is well accepted that current hydraulic and dynamic response technology cannot exactly define nor completely eliminate the root cause of the vibrations. It has been therefore, left to mechanical means to attempt to completely or at least substantially eliminate the vibration issue. While the advent of the antivibration bars or similar technology has materially reduced the magnitude and presence of vibration, they have not in the prior art completely eliminated damaging vibrations.

The mechanical aspects of the curved or bent portion of the tubes of the tube bundle are the major obstacles in the way of a mechanical solution to the problem.

The U-shaped tubes of the tube bundle have dimensional tolerances associated with their outer diameter. There are also dimensional variations caused by ovalization of the tubes as a result of the bending. Furthermore, the spatial relationship between adjacent tubes is a variable, albeit within set design limits. Thus, there is a dimensional tolerance associated with the nominal spacing between the steam generator tubes. There is also a dimensional tolerance associated with the outer dimensions of the prior art vibration bars, which as explained above, typically comprise rectangular bars. They may also comprise a square, an oval, or any other shape having a uniform or a nonuniform cross-sectional shape. However, notwithstanding the particular shape chosen, there is the dimensional tolerance associated with the size of the bars. The combination of these tolerances and dimensional variations prevents the elimination of gaps between the antivibration bars and the tubes of the steam generator. Any gaps are, of course, undesirable because they allow vibration of the tubes and relative motion between the tubes and the antivibration bars. The relative motion can cause wear and subsequent failure to the tubes of the steam generator. There have been numerous attempts in the prior art to minimize gaps. Unfortunately, decreasing the size of the gaps only decreases the magnitude of this issue, it does not eliminate the issue.

In one prior art application, a method was disclosed whereby hollow antivibration bars are expanded in place between the rows of steam generator tubes to eliminate the gaps due to dimensional variations. Some obvious limitations of this method include difficulty of using the method with previously operated steam generators which may be or are radioactive, and the difficulty in general of controlling the expansion in order to obtain acceptable gaps. Also, the hydraulically expandable bars must have a relatively thin wall for the expansion to occur to close the gaps, the thin wall is of concern if wear does occur.

Another prior art attempt to eliminate the gaps utilized compliant antivibration bars whereby bars which are slotted in the plane of columns of tubes present a compliant support for the tubes in contact with the bars. The slotted bars are then inserted between columns of tubes and attached to their ends to the retainer rings surrounding the exterior periphery of the bundle of tubes. While this unique apparatus is a further step in the right direction toward minimizing or eliminating gaps between antivibration bars, it too has its limitation. The need to make the bars compliant requires a relatively thin wall which is of concern if wear does occur. Also, the bars may be required to flex in alternating directions relative to its nominal centerline in order to accommodate the various sizes of the steam generator tubes which also requires a relatively thin wall.

A further prior art attempt to minimize the gaps between the antivibration bars and the steam generator tubes comprise expandable antivibration bars. In this prior art attempt a expandable support was disclosed whereby the antivibration bars are split along the plane of the columns of tubes and are provided with one or more sets of mating inclined planes at the split surfaces. The split halves allow relative motion between the halves of the antivibration bars while the inclined planes provide a means to increase or decrease the overall thickness of the antivibration bars. In this manner it was hoped that the space between columns of steam generator tubes could be fitted with antivibration bars whose thicknesses coincide with the actual distance between the rows of tubes. However, because the steam generator tube diameters vary significantly throughout the columns of tubes, the two parallel plane surfaces of the expandable bars may result in locations with gaps larger than desired.

Accordingly, there still exists a need for other and better methods to minimize or eliminate the gaps between the steam generator tubes and the antivibration bars in order to prevent damaging vibrations of the steam generator tubes and to eliminate any relevant motion between the antivibration bars and the steam generator tubes.

Accordingly, an object of the present invention is to provide a method and apparatus which prevents operational vibrations of the tubes of the steam generator.

Another object of the present invention is to provide a method of manufacturing antivibration bar apparatus which virtually eliminates any gaps between the antivibration bar and the tubes of a steam generator.

Additional objects and advantages as well as the advancement of the art are illustrated and disclosed in the present invention over the prior art and will become apparent in accordance with the following Summary of the Invention which is not intended to limit the scope of the invention which is expressed in the claims which follow the description herein.

SUMMARY OF THE INVENTION

The above specifically expressed objects as well as those implied but not expressed and based upon a fair reading and interpretation of this specification are provided by the present invention which comprises a method and apparatus for manufacturing antivibration bars to substantially coincide with the size and direction of the spacings between adjacent tubes of the columns of steam generator tubes and to compensate for the variations in the actual tube diameters of the steam generator tubes.

In one preferred method, steam generator tubes are laid out in the pattern of a particular column of tubes as they will actually fit in the steam generator. A profile of the tube diameters is made at the locations where the antivibration bars will contact the tubes. The profile may be made by passing a roller attached to a linear variable differential transducer to interpret the tube diameters. The actual diameters as they are measured may be stored in magnetic tape. The tape can then be used to drive numerically controlled machining apparatus which contours the thickness of the antivibration bars in the direction of the flow tubes to result in a near-zero gap between the tubes and the antivibration bars in the assembled condition. If desired, the information obtained concerning the diameter of the tubes may be used to correspondingly pre-load each of the tubes in the U-bend region of the tubes by adding a nominal dimension to each of the actual spaces between the columns of tubes.

Various other objects, advantages and features of the invention will become apparent to those skilled in the art from the following description taken in conjunction with the following drawings, in which:

DESCRIPTION OF THE PREFERRED EMBODIMENTS

Figure 1:
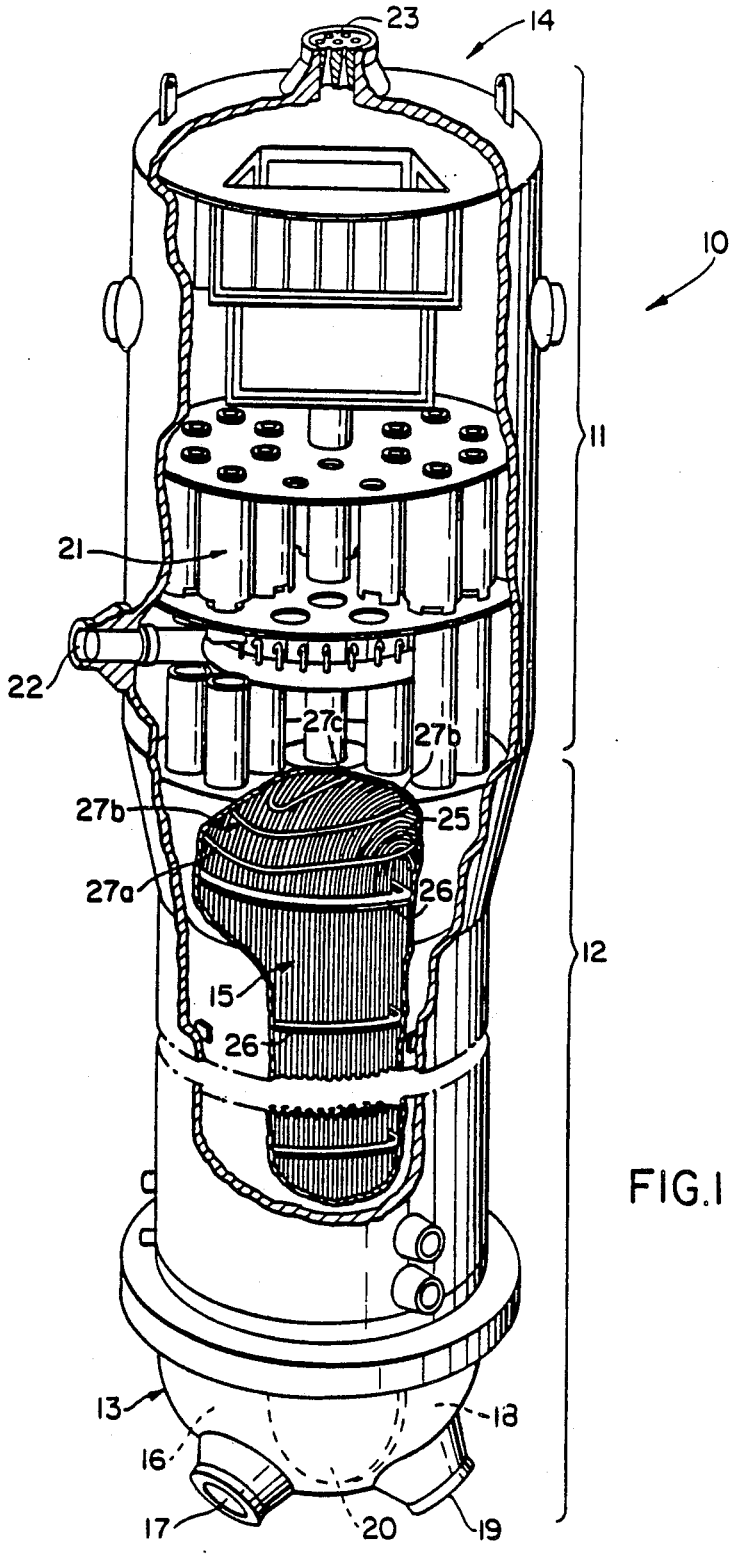
FIG. 1 is a perspective view, partially in cross section, of a nuclear steam generator having U-shaped bent tubes to which the antivibration method of the present invention may be applied.
Figure 2:
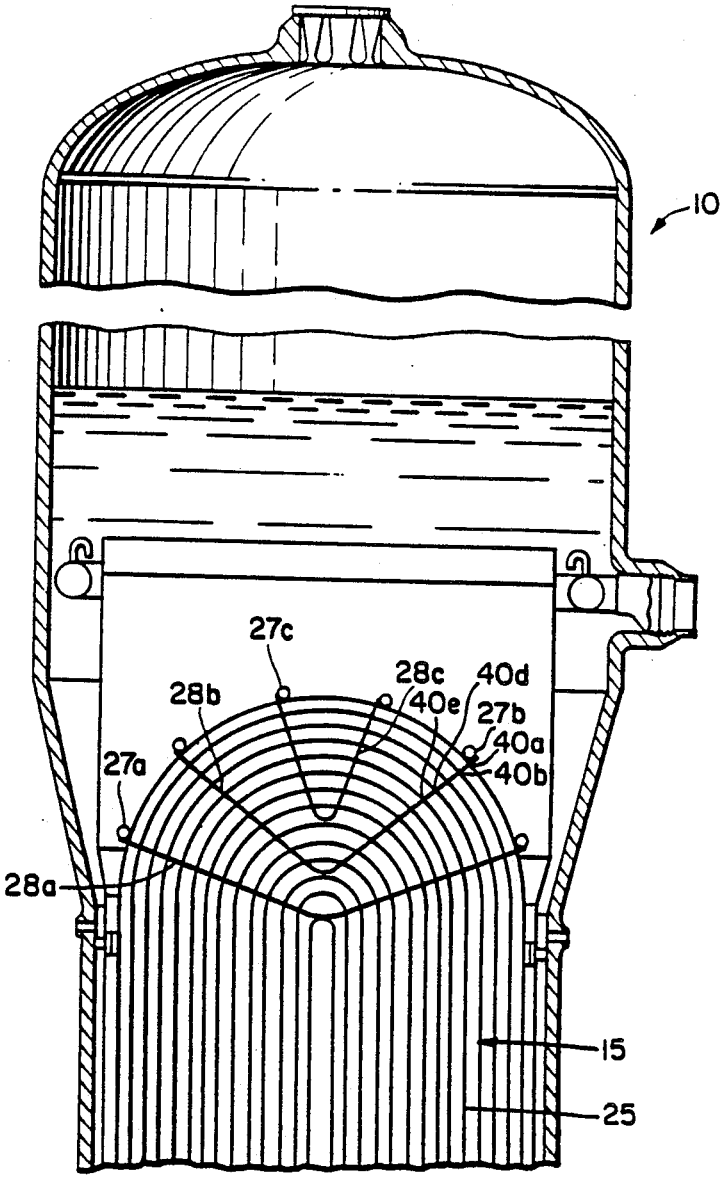
FIG. 2 is a schematic rendering of an axial section of the upper portion of the steam generator of FIG. 1, particularly illustrating the portion of the flow tubes and a typical installation position of the antivibration apparatus manufactured in accordance with the present invention.

Referring now to the drawings where like characteristics are referred to by the same reference numerals among the various figures and in particular to FIGS. 1 and 2 which depict a typical steam generator to which the present invention may be applied. To the extent that the steam generator is described and explained in the description of prior art above, that description and explanation of operation is incorporated in the embodiment shown and described herein by reference as if fully set forth.

The nuclear steam generator 10 comprises a substantially cylindrical shell having upper 11 and lower 12 portions. A hemispherical head or channel head 13 is sealingly attached to the lower portion 12. A bundle 15 of U-shaped tubes is disposed within the lower portion 12. One open end of the tube bundle 15 is in flow communication with the hot leg 16 of channel head 13 and a primary coolant flow inlet nozzle 17. The other open end of the tube bundle 15 is in flow communication with the cold leg 18 of channel head 13 and a primary coolant flow outlet nozzle 19. A partition 20 divides the hot 16 and cold 18 legs of the channel head 13. Thus, hot reactor coolant flows into steam generator 10 through inlet nozzle 17, through hot leg 16 into tube bundle 15, through and out of tube bundle 15. The now cooled reactor coolant flows through cold leg 18 and out of outlet nozzle 19 and back to the nuclear reactor to continue the flow cycle.

That portion 12 of the steam generator 10 primarily including the tube bundle 15 and channel head 13 is referred to as the evaporator portion. The upper portion 11 of steam generator 10 is normally referred to as the steam drum portion which includes a moisture separator 21. Feedwater enters the steam generator 10 through an inlet nozzle 22 and mixes the water removed by the moisture separator 21. The feedwater flows down an annular channel surrounding tube bundle 15 and is introduced into tube bundle 15 at the bottom thereof. The mixture of feedwater and recirculating water then flows up through tube bundle 15 where it is heated to a boil by the water flowing within the tubes 25 of tube bundle 15. The steam produced by the boiling feedwater rises up into the steam drum portion 11 where the moisture separator 21 removes water entrained within the steam before the steam exits through a steam outlet nozzle 23. The steam then flows to a steam outlet nozzle 23. The steam then flows to a steam turbine (not shown) and subsequently back into the steam generator where the cycle is continued.

The U-shaped tubes 25 are supported along their straight lengths in the configuration of the tube bundle 15 by a series of support plates 26. The bent or U-shaped portion of tubes 25 are supported by an assembly comprising a series of retainer rigs **27*a*, 27*b*, and 27*c*. Each of the retainer rings is generally of round or oval configuration with 27*b* being smaller than 27*a*, and 27*c* progressively smaller than 27*b*. A plurality of sets of antivibration bars 28 is disposed between adjacent columns of the U-shaped tubes 25. One such set of antivibration bars 28 is more clearly shown in FIG. 2, it being understood that successive sets of similar antivibration bars 28 are disposed behind and in front of the illustration set. Each of the antivibration bars 28*a*, 28*b*, and 28*c* is of a V-shaped configuration with differing included angles and with the ends thereof attached, such as by welding, to symmetrically opposite points of the respective retainer rings 27*a*, 27*b*, and 27*c*. FIG. 2 illustrates a cross-sectional schematic view taken through the tube bundle 15 showing that the antivibration bars 28*a*, 28*b*, and 28*c* are disposed to support the bent or U-shaped portion of tubes 25, noting the row and column arrangement of tubes 25**.

Prior to positioning or installing each column of steam generator tubes 25, the individual tubes 25 for a particular steam generator may be laid out column by column in the actual arrangement as they will be positioned in the particular steam generator. The column of tubes shown in FIG. 2 of the drawings represents a central column and is typical of the manner in which the tubes will be laid out. The actual diameter of each flow tube 25 may then be taken along the lines of the antivibration bars 28*a*, 28*b*, and 28*c* as depicted in FIG. 2. While FIG. 2 only schematically illustrates one column of flow tubes of the steam generator, it is to be understood that the measurements of the diameter of the flow tubes are to be taken for each successive set of tube columns. In this manner, the diameter of every flow tube to be installed in a steam generator will be recorded along the intended lines of locations of the antivibration bars.

Figure 3:
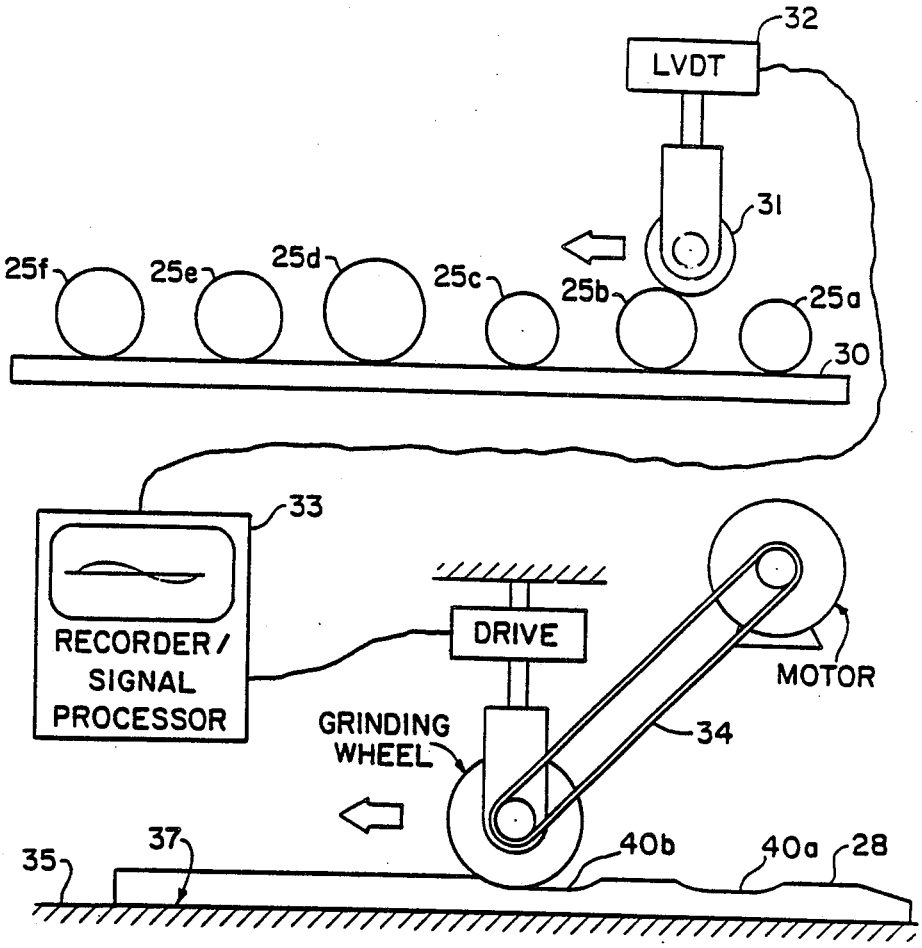
FIG. 3 schematically illustrates one embodiment of apparatus utilizing the steps involved of the present inventive method; and, FIG. 4 illustrates portions of an antivibration bar showing, in plan view, the matching of cutouts in a typical antivibration bar with the direction of representative flow tubes shown in FIG. 2.

In FIG. 3, a typcial representative portion of a column of flow tubes 25 is depicted. The column of flow tubes are arranged side by side on a suitable work surface 30 which is flat. As previosuly stated, the flow tubes 25 are laid out in the pattern of the particular column of tubes as they will actually fit into a particular steam generator. A profile of each of the tube diameters 25*a*, 25*b*, 25*c*, 25*d*, 25*e*, and 25*f*, etc., is obtained by passing a roller 31 with a linear variable differential transducer 32 appropriately and operationally attached thereto. The output from the differential transducer 32 may be fed to a magnetic tape shortage unit 33 which records the measured actual diameter of each of the flow tubes 25. In a similar fashion, each of the actual diameters of all the flow tubes in the steam generator at the locations of the antivibration bars is determined and recorded. Thus, the diameters of a single tube may be measured at one to six locations along the length of the tube depending upon how many locations along the length thereof are in contact with an antivibration bar (see FIG. 2). The method further contemplates that corresponding cross-reference of the measured actual tube diameters are made and stored relative to the respective antivibration bars to be located with respect to the particular sets of columns of tubes and with reference to the particular antivibration bars to be located at the respective positions across the column of tubes (see FIG. 2).

Figure 4:
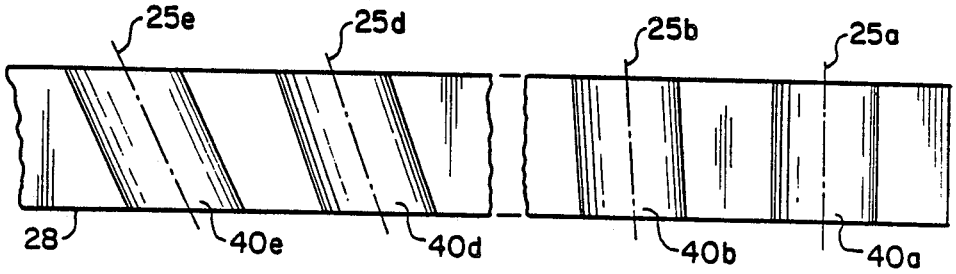
Figure 5:
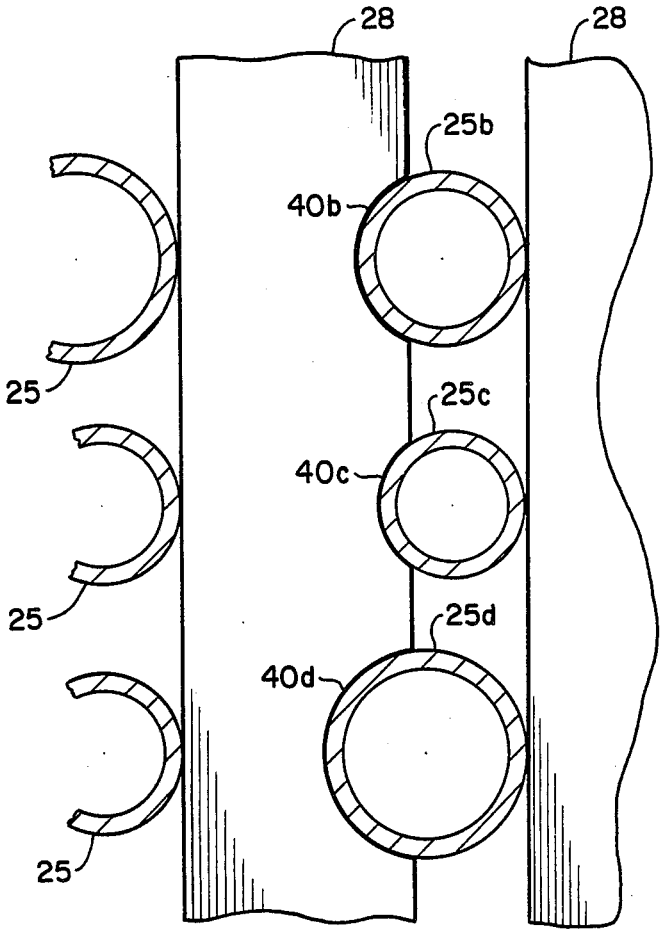
FIG. 5 is a typical cross-sectional view of an antivibration bar illustrating the cutout configuration thereof in conjunction with typical positioning of flow tubes of varying diameter.

The magnetic tape produced in accordance with the method described herein and as obtained from the magnetic tape storage unit 33 may then be used to drive an appropriate numerically controlled machining apparatus such as a grinding machine 34 to accurately contour the shape or thickness of the individual antivibration bars 28 to correspond to the particular measured diameters of the flow tubes 25. Thus, contour 40*a* would correspond to the measured diameter of flow tube 25*a*. It is to be noted that grinding machine 34 provides for turning the grinding wheel so that its axial centerline may be oriented either parallel to or perpendicular to the longitdinal axis of antivibration bar 28 or an any angle therebetween in order to orient the centerlines 25*a*, 25*b*, . . . 25*d*, 25*e*, etc., of contours 40*a*, 40*b*, . . . 40*d*, 40*e*, etc., respectively, to coincide with the orientation of the flow tubes relative to the antivibration bars. See in this regard FIGS. 2 and 4.

In a preferred embodiment, the antivibration bars 28 may be made of stainless steel type 405. Still referring to FIG. 3, the antivibration bar 28 depicted therein may be mechanically affixed to the bed 35 of the numerically controlled grinding machine 34. The antivibration bars of the prior art are nominally 0.75 of an inch wide and 0.313 inches thick; such dimensions are considered to be appropriate for the antivibration bars 28 of the present invention. Individual bars 28 may be machined only on one side as shown in FIG. 3 because the flexibility of the flow tubes 25 will permit the diameter of the tubes opposite the point at which they contact the contours 40 of the antivibration bars, to assume a substantially straight line which then coincides with the flat unmachined side 37 of each of the antivibration bars 28. In other words, in place in the steam generator, the locating points along the diameter of the flow tubes 25 which when measured were in contact with the flat bed or work surface 30 would then contact the flat surface 37 of the antivibration bar 28 when installed in a steam generator.

Since the antivibration bar retainer rings 27 have been usually made from Inconel, an Inconel end piece may be mechanically attached (not shown) to the ends of each of the antivibration bars 28 to provide a compatible connection between the antivibration bars and the retainer rings. If desired, antivibration bars 28 may be made from Inconel so as to eliminate the need for a Inconel end piece.

In another embodiment, the inventive method contemplates the measurement of the diameter of the tubes 25 by an appropriate automatic machine, such as that shown in FIG. 3, subsequent to the bending thereof. Each tube would be individually numbered and prepositioned for use in a steam generator with each tube being logged as to its pre-position and number. This information may be subsequently stored into an appropriate computer. The steam generator tube bundle 15 would then be built in accordance with the assigned pre-positions. Then, by correlating the tube diameter measurements with the positions of the tubes in the bundle in the steam generator as actually built, the computer which directs the numerically controlled machining apparatus can configure the individual antivibration bars to the as-built tube bundle configuration.

It is to be further noted that machining of contours 40 need not be restricted to grinding. Any machining or metal forming method may be used provided that the appropriate and correct thickness across the antivibration bars are effectuated at contours 40.

In order to also assure the elimination of gaps between columns of flow tubes, the following procedure may be used. Measuring and recording the actual diameter of the flow tubes at the location of the antivibration bars, forming a plurality of spaced apart cutouts along the length of the antivibration bars approximately transverse to the longitudinal axis thereof, each of the cutouts being formed to a depth proportional to the actual measured diameter of the flow tube fitting within the cutout and such that the remaining thickness of the bar between the bottom of the cutout and the flat other side of the bar is substantially equal to the actual space between a side-by-side pair of flow tubes in adjacent columns of flow tubes. This procedure may be carried one step further by adding a nominal distance to the remaining thickness of the bars such that the pitch distance comprising the actual tube diameters plus the remaining thickness across the bars is greater than the pitch distance comprising the actual tube diameters plus the actual space between the respective columns of flow tubes by the added nominal distance.

Vibrations associated with the steam generator flow tubes 25 may be further eliminated by utilizing the actual tube diameter information as measured above to machine the holes in the top tube support plate 26 such that little or no clearance exists between the actual varying outer diameter of the flow tubes 25 at the top tube support plate 26 location.

While the invention has been described, disclosed, illustrated and shown in certain terms of certain embodiments or modifications which is has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

We claim as our invention:

1. A method for manufacturing antivibration bars for a steam generator comprising a housing, a bundle of U-shaped flow tubes of slightly varying diameter within said housing arranged in side-by-side columns with a varying space between each pair of said side-by-side flow tubes, said varying space being in accordance with the varying diameter of each flow tube comprising the steps of arranging each flow tube in its respective location within its respective column measuring and recording the actual diameter of each flow tube at a location where an antivibration bar is to be used, said antivibration bars each comprising an elongated bar with one side having axially spaced contoured cutouts along the length thereof and the other side of said bar being flat forming each cutout to a depth consistent with the actual diameter of the respective flow tubes fitting within said cutout and such that the opposite flat side of said bar contacts the outer diameter of said flow tubes in an adjacent column of flow tubes.

2. The method of claim 1, including the step of forming each of said contoured cutouts to substantially that of a segmented cylinder with its longitudinal axis approximately transverse to the longitudinal axis of said bar.

3. The method of claim 2, including the step of orienting each of said contoured cutouts with its longitudinal axis substantially parallel to the longitudinal axis of the respective flow tubes fitting within said cutouts.

4. The method of claim 1, including the step of bending said flow tubes into their respective U-shapes prior to measuring and recording the diameter at the location of an antivibration bar.

5. A method for manufacturing antivibration bars for a steam generator comprising a housing, a bundle of U-shaped flow tubes of slightly varying diameter within said housing arranged in side-by-side columns with a varying space between each pair of said side-by-side flow tubes, said varying space being in accordance with the varying diameter of each flow tube comprising the steps of arranging each flow tube in its respective location within its respective column measuring and recording the actual diameter of each flow tube at a location where an antivibration bar is to be used, said antivibration bars each comprising an elongated bar with one side having axially spaced contoured cutout along the length thereof and the other side of said bar being flat forming each cutout to a depth consistent with the actual measured diameter of the respective flow tube fitting within said cutout such that the thickness between the bottom of the contoured cutouts and the flat side of said bars at each of said contoured cutouts comprises the space between side-by-side pairs of flow tubes in adjacent columns plus a nominal distance, said nominal distance being the same for each cutout of all the antivibration bars used in the steam generator whereby the side-by-side space between columns of flow tubes are all individually increased by the same nominal distance.

6. The method of claim 5, including the step of forming each of said contoured cutouts to substantially that of a segmented cylinder with its longitudinal axis approximately transverse to the longitudinal axis of said bar.

7. The method of claim 6, including the step of orienting each of said contoured cutouts with its longitudinal axis substantially parallel to the longitudinal axis of the respective flow tubes fitting within said cutouts.

8. The method of claim 7, including the step of bending said flow tubes into their respective U-shapes prior to measuring and recording the diameter at the location of an antivibration bar.

* * * * *